US006511197B1

(12) United States Patent
Kalemjian

(10) Patent No.: US 6,511,197 B1
(45) Date of Patent: Jan. 28, 2003

(54) ILLUMINATED DRINKING VESSEL WITH RELEASABLY ATTACHABLE LIGHT SOURCE

(75) Inventor: Ashley Kalemjian, 400 S. Church St., West Chester, PA (US) 19380

(73) Assignee: Ashley Kalemjian, West Chester, PA (US)

( * ) Notice: Subject to any disclaimer, the term of this patent is extended or adjusted under 35 U.S.C. 154(b) by 0 days.

(21) Appl. No.: 09/906,238

(22) Filed: Jul. 16, 2001

(51) Int. Cl.[7] ..... F21W 131/30
(52) U.S. Cl. ..... 362/101; 362/802
(58) Field of Search ..... 362/96, 101, 154, 362/155, 802, 253

(56) References Cited

U.S. PATENT DOCUMENTS

| | | | | | |
|---|---|---|---|---|---|
| 919,691 | A | | 4/1909 | Cahill | |
| 2,177,337 | A | | 10/1939 | Stein | 240/6.4 |
| 2,224,319 | A | | 12/1940 | Schroyer | 240/6.4 |
| 2,663,866 | A | * | 12/1953 | Simpson | 362/101 |
| 4,922,355 | A | * | 5/1990 | Dietz et al. | 362/101 |
| 5,211,699 | A | * | 5/1993 | Tipton | 362/101 |
| 5,879,068 | A | | 3/1999 | Menashrov et al. | 362/101 |
| 6,005,204 | A | * | 12/1999 | Choi et al. | 362/101 |

FOREIGN PATENT DOCUMENTS

| | | | | |
|---|---|---|---|---|
| FR | 2465154 | * | 4/1981 | 362/101 |

* cited by examiner

*Primary Examiner*—Laura K. Tso
(74) *Attorney, Agent, or Firm*—Woodcock Washburn LLP

(57) ABSTRACT

An illuminated drinking vessel includes a fluid retaining cup and a light housing which is releasably attached via a snap-connection. A light emitting diode(s) is mounted within the light housing and a switch mechanism is provided for selectively connecting the light emitting diode with a battery(s) mounted or inserted within the light housing. More particularly, the switch mechanism is provided that is actuated when the light housing is attached to the drinking vessel by snap-connection.

3 Claims, 5 Drawing Sheets

ILLUMINATED DRINKING VESSEL WITH RELEASABLY ATTACHABLE LIGHT SOURCE

BACKGROUND OF THE INVENTION

Drinking vessels such as cups, mugs and wine glasses are in quite common usage. Many times such drinking vessels are utilized in dimly-lit environments. In such conditions, it would be helpful to utilize the drinking vessel itself to provide some form of illumination, not only from a utilitarian point of view but also from an entertaining and/or aesthetic point of view. The combination of one or more lights with a drinking vessel can be attractive to the user and can provide a form of amusement.

There have been a number of lighted drinking vessels devised, which all incorporate some type of light associated with a drinking cup, a power source and a switch. For example, in U.S. Pat. No. 919,691, a subbase separable from the drinking vessel is provided for housing a battery. When the drinking vessel is placed on the subbase, an incandescent electric lamp is caused to be illuminated. In another illuminated drinking vessel the illumination is accomplished automatically by the raising of the receptacle through a switch in the base, as shown in U.S. Pat. No. 2,177,337. In a like manner, the illuminated drinking vessel of U.S. Pat. No. 2,224,319 has a switch mechanism in the base of the drinking vessel which causes a lamp to be illuminated whenever the drinking vessel is held in one's hand, but extinguishes the light when the drinking vessel is placed on a tray or table. There has also been devised a drinking vessel, as show in U.S. Pat. No. 5,879,068, wherein the lamp is turned on when the cup is filled with fluid or where the switch is actuated manually by lifting the drinking vessel.

A drinking vessel is needed which permits a user to remove the light emitting means to facilitate replacement, reuse, and repair. Replacement in the sense that the light emitting means and battery(s) may be individually replaced without having to replace the entire illuminated drinking vessel. Reuse in the sense that the light emitting means may be removed during the washing of the illuminated drinking vessel thereby eliminating the possibility of damage to the light and/or battery due to contact with water in the course of washing said illuminated drinking vessel. Repair in the sense that in the event of damage to the light emitting means, it may be replaced thereby retaining the original illuminated drinking vessel.

SUMMARY OF THE INVENTION

The present invention resides in an illuminated drinking vessel having a light emitting means enclosed within a light-housing attached via a snap connection. A light emitting means is enclosed within a light housing such as a split-ring or a puck-shaped base and attached via a snap connection. The split ring or puck-shaped base containing the light emitting means are releasably attachable and removable, thereby facilitating replacement, reuse and repair of the drinking vessel.

In a preferred form of the invention, the fluid retaining cup is permanently connected to the lower supporting stem. The light emitting means comprises a light emitting diode which is enclosed within a split-ring. A battery is mounted within the split-ring to provide power for the light emitting diode. The split-ring containing the light emitting diode is releasably attached to a cylindrical rod between the upper fluid-retaining cup and the lower supporting stem wherein the light serves the purpose of illuminating the fluid contents within the fluid-retaining cup.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
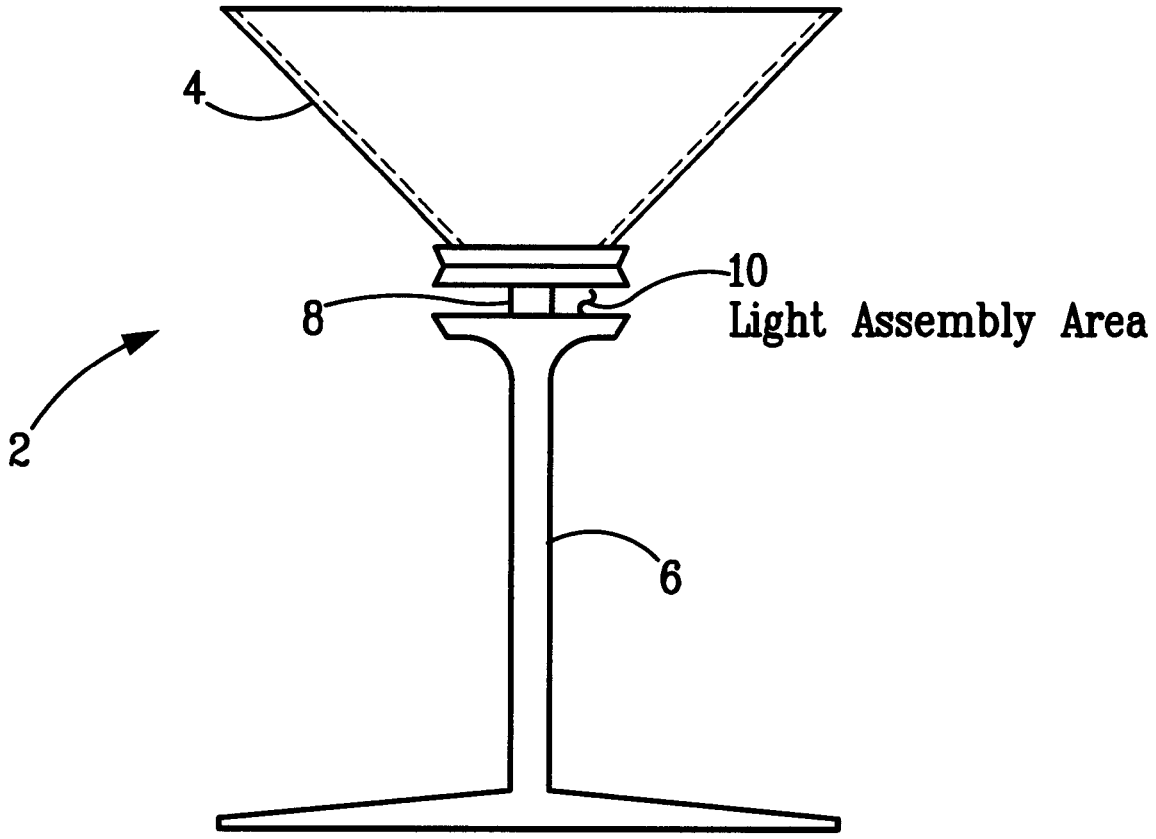
FIG. 1 is a side perspective view of an illuminated drinking vessel embodying the present invention.

As shown in the drawings for purposes of illustration, the present invention is concerned with an illuminated drinking vessel, generally designated by the reference number 2. As illustrated in FIG. 1, one embodiment of the illuminated drinking vessel 2 comprises an upper fluid retaining cup 4, and a lower supporting stem 6 which are permanently connected. Typically the drinking vessel 2 is manufactured of a transparent or translucent material. A cylindrical rod 8 extends between cup 4 and stem 6 in a light assembly area 10.

Figure 2:
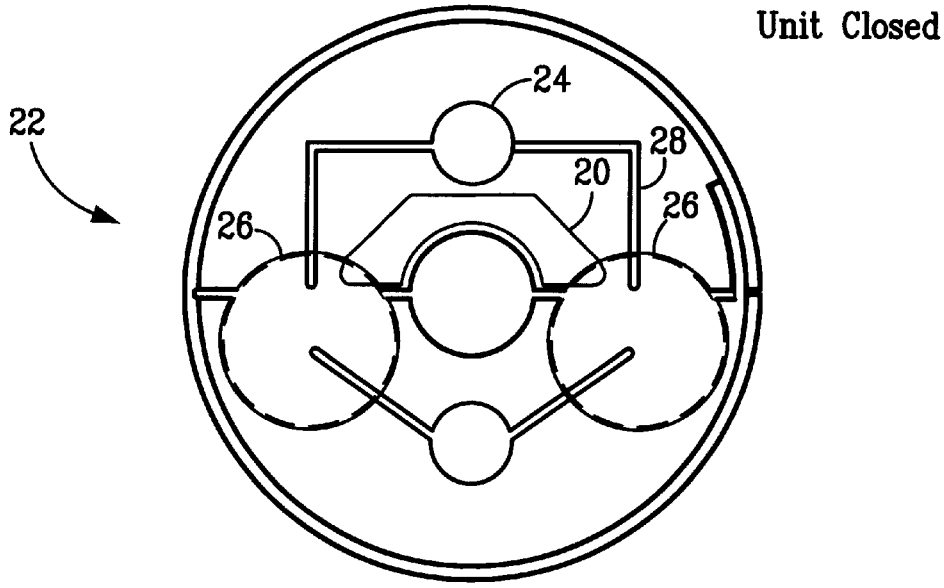
FIG. 2 is a top perspective of the split ring with the unit in the closed position.
Figure 3:
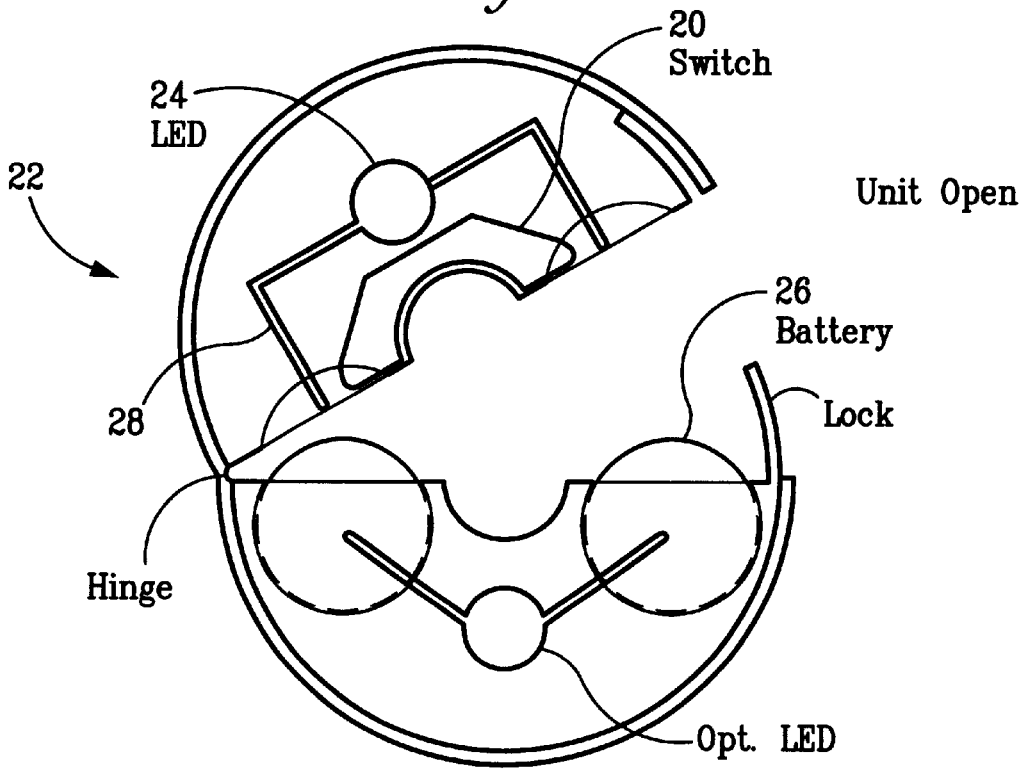
FIG. 3 is a top perspective of the split ring with the unit in the open position.

As illustrated in FIG. 2 and 3, a switch mechanism 20 comprises a snap connection that is mounted on the end of the split-ring 22. This switch mechanism 20 may be positively engaged by releasably attaching the split-ring by snap connection onto the cylindrical rod 8 in the light assembly area 10 of the split ring 22 is the illuminated drinking vessel 2 of FIG. 1 located between the upper fluid retaining cup 4 and the lower supporting stem 6 to energize a light emitting means, such as the light emitting diode(s) 24 to illuminate the drinking vessel 2.

More particularly, and with reference to FIGS. 2 and 3, the light emitting diode 24 is located within the split-ring 22. A battery(s) 26 is mounted or inserted inside the split-ring 22 and beside the light emitting diode(s) 24. A circuit 28 extends between the light emitting diode(s) 24 and the battery(s) 26 through the switch mechanism 20. This permits the switch mechanism to be actuated by snapping the split-ring 22 onto the cylindrical rod 8. The split-ring 22 of FIGS. 2 and 3 forms a snap connection that closes the circuit 28 between the battery(s) 26 and the light emitting diode(s) 24 to illuminate the light emitting diode(s) 24.

Figure 4:
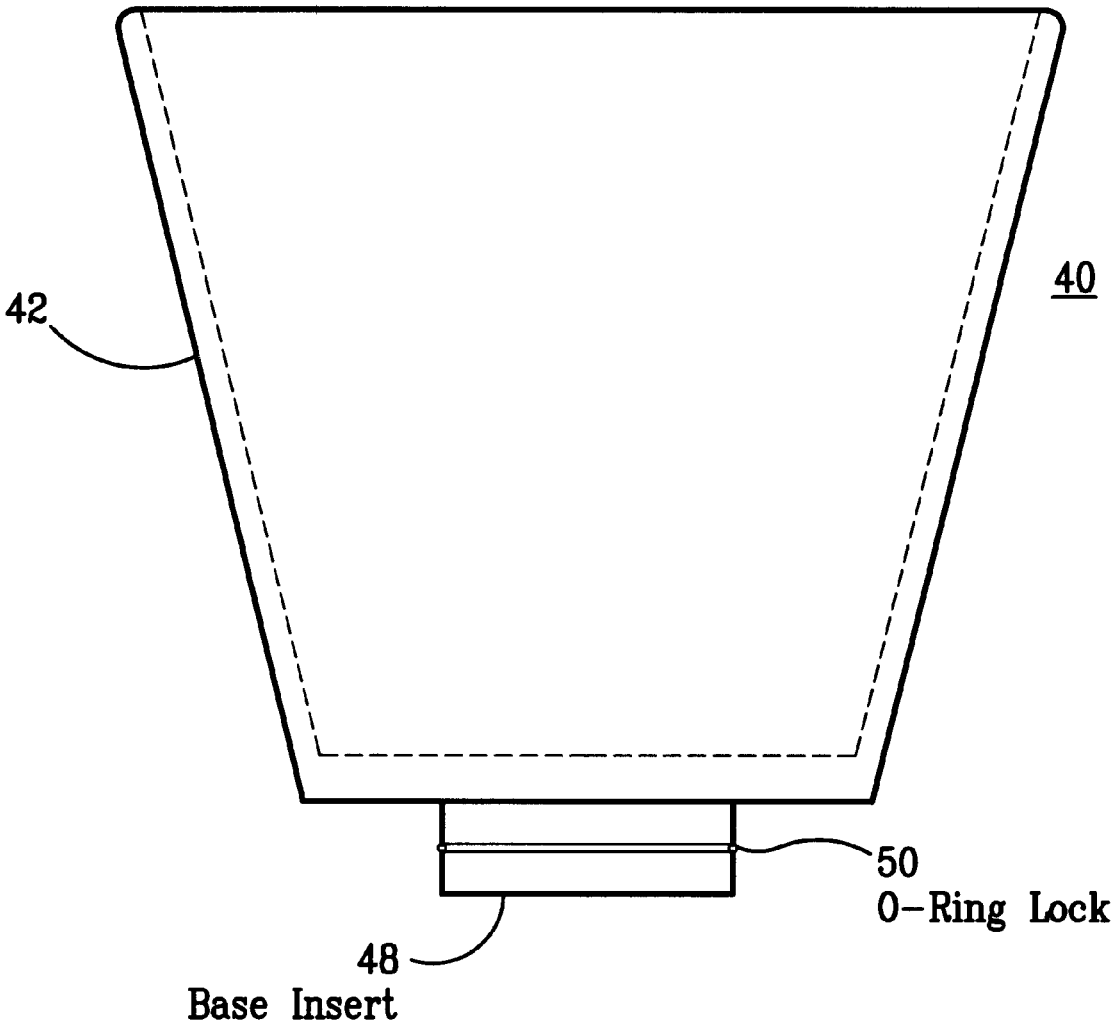
FIG. 4 is a side perspective view of the tumbler shaped illuminated drinking vessel embodying the present invention.
Figure 5:
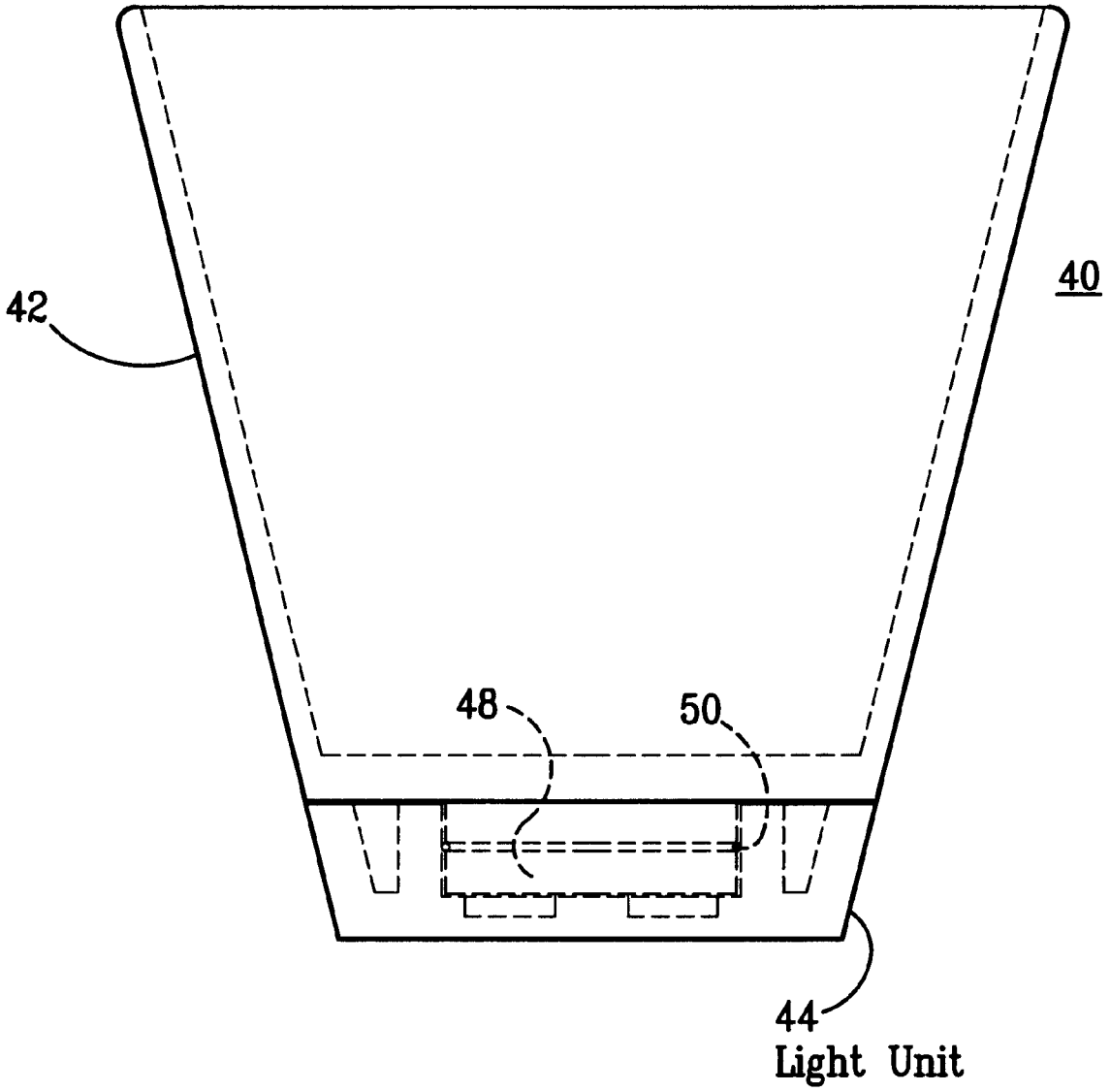
FIG. 5 is a side perspective of the tumbler shaped illuminated drinking vessel with a releasably attachable puck-shaped base in place.

As illustrated in FIGS. 4 and 5, an alternative embodiment of the present invention is a tumbler shaped drinking vessel 40. The tumbler shaped drinking vessel 40 comprises an upper tumbler shaped glass 42 and a lower light unit or coaster unit 44 which includes a base-insert 48. The light unit 44 is connected to the glass 42. An O ring lock 50 seals the base unit 48. Typically the tumbler shaped drinking vessel 42 is manufactured of a transparent or translucent material.

Figure 6:
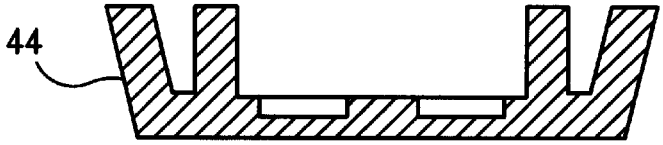
FIG. 6 is a section on the line a—a of FIG. 7.
Figure 7:
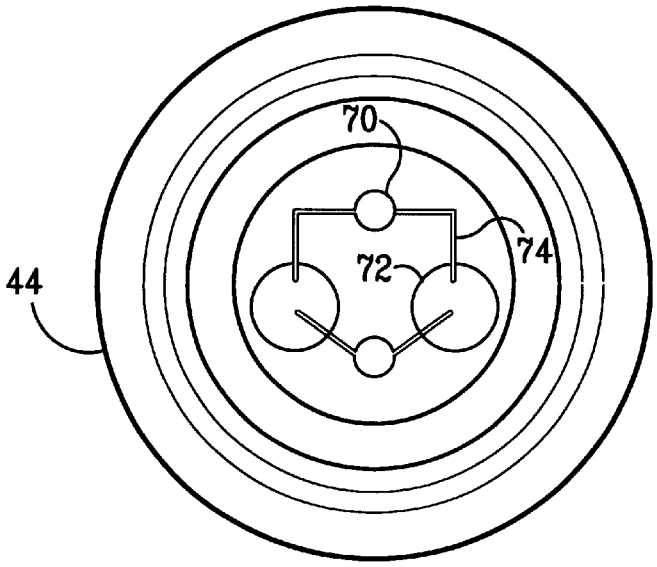
FIG. 7 is a top perspective of the puck-shaped base.

As illustrated in FIGS. 5–7, a switch mechanism (detailed in FIG. 8) comprises a twist-snap connection mounted on the lower base-insert 48. This switch mechanism 76 may be positively engaged by twisting and snapping the puck-shaped light unit 44 onto the base insert 48 of the tumbler shaped drinking vessel 40. The upper tumbler shaped glass 42 depresses the spring switch 76 and completes the circuit to energize a light emitting means, such as the light emitting diode(s) 70 (as shown in FIGS. 7 and 8) to illuminate the tumbler shaped drinking vessel 40.

Figure 8:
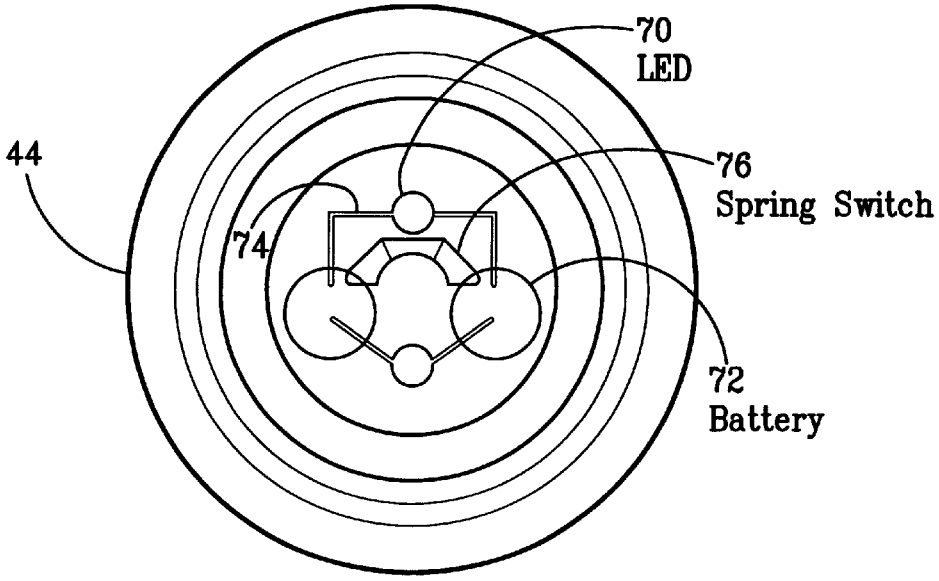
FIG. 8 is a top perspective of the puck-shaped base with the spring switch shown.

More particularly, and with reference to FIGS. 6, 7 and 8, the light emitting diode(s) 70 is located within the puck-shaped light unit 44. A battery(s) 72 is mounted inside the puck-shaped base 44 and beside the light emitting diode(s) 70. A circuit 74 extends between the light emitting diode(s) 70 and the battery(s) 72 through the spring-switch mechanism 76. This permits the spring-switch upon being actuated by the twist-snap connection to close the circuit 76 thereby illuminating the light emitting diode(s) 70.

From the foregoing it will be appreciated that a novel illuminated drinking vessel has been provided which has a circuit 74 extending between a battery(s) 72 and the light emitting diode(s) 70. A switch mechanism 76 is provided which, when not snapped, is open to interrupt power supply from the battery(s) 72 to the light emitting diode(s) 70. When the switch mechanism 76 is snapped-together, however, the circuit 74 is closed. Power is thus supplied to the light emitting diode(s) 70 to illuminate it and the transparent or translucent upper fluid retaining cup portion of the drinking vessel.

Although a particular embodiment of the invention has been described in detail for purposes of illustration, various modifications may be made without departing from the spirit and scope of the invention. Accordingly, the invention is not to be limited, except as by the appended claims.

I claim:

1. An illuminated drinking vessel, comprising:

a fluid-retaining cup;

a lower supporting stem, said fluid retaining cup being permanently connected to said lower supporting stem;

a light emitting means enclosed within a split-ring, said split-ring being attached to a cylindrical rod between said fluid-retaining cup and said lower supporting stem via a snap-connection of the ends of said split-ring around said cylindrical rod;

at least one battery within said split ring; and a switch mechanism for a circuit between said light emitting means and said battery, the switch mechanism being actuated by said snap-connection.

2. An illuminated drinking vessel, comprising:

a fluid-retaining cup;

a lower supporting stem;

a cylindrical rod permanently connected to said lower supporting stem;

a split ring;

a light emitting means enclosed within said split-ring, said split ring being releasably attached to said cylindrical rod between the fluid-retaining cup and the lower supporting stem by a snap-on mechanism;

at least one battery mounted or inserted within said split-ring;

a switch mechanism for a circuit between the light emitting means and the battery or batteries, the switch mechanism being actuated by snapping the split-ring together.

3. The invention described within claim 2 wherein said light emitting means is at least one light emitting diode.

* * * * *